US012780510B2

(12) United States Patent
Mazursky et al.

(10) Patent No.: US 12,780,510 B2
(45) Date of Patent: Nov. 3, 2026

(54) SYSTEMS AND METHODS FOR DISPENSING MEDICATION OR FOOD PRODUCTS FROM A CONTAINER

(71) Applicant: PDQ Mazoo, LLC, Northbrook, IL (US)

(72) Inventors: Richard Mazursky, Northbrook, IL (US); Ruth Green-Synowic, Naperville, IL (US)

(73) Assignee: PDQ Mazoo, LLC, Northbrook, IL (US)

( * ) Notice: Subject to any disclaimer, the term of this patent is extended or adjusted under 35 U.S.C. 154(b) by 211 days.

(21) Appl. No.: 18/631,306

(22) Filed: Apr. 10, 2024

(65) Prior Publication Data

US 2024/0343456 A1 Oct. 17, 2024

Related U.S. Application Data

(60) Provisional application No. 63/459,488, filed on Apr. 14, 2023.

(51) Int. Cl.

| | |
|---|---|
| ***B65D 5/38*** | (2006.01) |
| ***B65D 21/02*** | (2006.01) |
| ***B65D 25/04*** | (2006.01) |
| ***B65D 25/20*** | (2006.01) |
| ***B65D 43/16*** | (2006.01) |
| ***B65D 50/04*** | (2006.01) |
| ***B65D 83/04*** | (2006.01) |

(52) U.S. Cl.
CPC ..... *B65D 50/045* (2013.01); *B65D 21/0204* (2013.01); *B65D 25/04* (2013.01); *B65D 25/205* (2013.01); *B65D 43/162* (2013.01); *B65D 83/04* (2013.01)

(58) Field of Classification Search
CPC ..... A61J 1/03; B65D 5/38; B65D 50/045; B65D 21/0204; B65D 25/04; B65D 25/108
USPC ..... 206/534, 538; 220/510, 531, 557
See application file for complete search history.

(56) References Cited

U.S. PATENT DOCUMENTS

| | | | | |
|---|---|---|---|---|
| 2,740,546 | A * | 4/1956 | Kowalski | B65D 25/108 211/74 |
| 4,344,646 | A * | 8/1982 | Michel | E05B 65/5276 292/87 |
| 4,693,371 | A * | 9/1987 | Malpass | B65D 1/36 206/561 |
| 5,285,907 | A * | 2/1994 | Franchere | F16M 13/00 211/74 |
| 5,353,956 | A * | 10/1994 | Wilson | A45D 40/02 426/115 |

(Continued)

*Primary Examiner* — Steven A. Reynolds
(74) *Attorney, Agent, or Firm* — McAndrews, Held & Malloy, Ltd.

(57) ABSTRACT

A container for dispensing food products or medication comprising: a rectangular compartment comprising gripping elements for gripping the rectangular compartment by a user, and connecting members, the connecting members being on two opposite sides of the rectangular compartment and operable to attach one or more other containers to the container; and a lid portion, wherein the rectangular compartment and the lid portion are connected via a living hinge and comprise a closing mechanism and a safety mechanism to hinder opening of the container.

16 Claims, 7 Drawing Sheets

(56) References Cited

U.S. PATENT DOCUMENTS

| | | | | |
|---|---|---|---|---|
| 5,417,339 | A * | 5/1995 | Liu | B65D 43/169 220/837 |
| 6,709,684 | B2 * | 3/2004 | Loth | B65D 43/162 206/800 |
| 7,150,355 | B2 * | 12/2006 | Coe | A61J 1/03 206/532 |
| 8,066,122 | B2 * | 11/2011 | Beecroft | B65D 83/0463 206/536 |
| 8,317,027 | B2 * | 11/2012 | Pabari | A61J 1/03 206/532 |
| 8,567,598 | B2 * | 10/2013 | Gibson | B65D 5/6691 206/268 |
| 10,701,967 | B1 * | 7/2020 | Grigoryan | A24F 15/18 |
| 11,117,722 | B1 * | 9/2021 | Warner | B65D 50/045 |
| 2011/0127269 | A1 * | 6/2011 | Bucholtz | B29C 39/021 221/133 |
| 2017/0137184 | A1 * | 5/2017 | Burek | B65D 43/22 |

* cited by examiner

SYSTEMS AND METHODS FOR DISPENSING MEDICATION OR FOOD PRODUCTS FROM A CONTAINER

CROSS-REFERENCE TO RELATED APPLICATIONS/INCORPORATION BY REFERENCE

The present application claims priority under 35 U.S.C. § 119 (e) to provisional application Ser. No. 63/459,488 filed on Apr. 14, 2023. The above referenced provisional application is hereby incorporated herein by reference in its entirety.

FIELD

The present disclosure relates to systems and methods for storing and dispensing medication or food products from a container. More specifically, the present disclosure relates to containers for storing medication or food products that are efficient to manufacture, store, and transport, and provide storage for medication or food products of different shapes and sizes.

BACKGROUND

Typically, medication and some food products, such as gum, candy, etc. are provided in cylindrical containers with a cap at one end. However, such containers are cumbersome to maintain because the containers waste space when stored in cabinets, on shelves, etc. For example, cylindrical containers have wasted space between the containers when stored together. This leads to wasted space in medicine cabinets and on retail shelves, and to increased shipping costs when shipping. Additionally, the cylindrical containers and the caps for the cylindrical containers must also be stored, manufactured, and inventoried.

Moreover, labels placed on the container wrap around the container, which creates inefficiencies because a user must pick up the cylindrical container in order to be able to turn the container and read the entire label. In cases where multiple containers are stored together, a consumer must pick up each individual container in order to read the label and find the correct container.

Further limitations and disadvantages of conventional and traditional approaches will become apparent to one of skill in the art, through comparison of such systems with some aspects of the present disclosure as set forth in the remainder of the present application.

SUMMARY

Certain embodiments provide a container for dispensing food products or medication, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
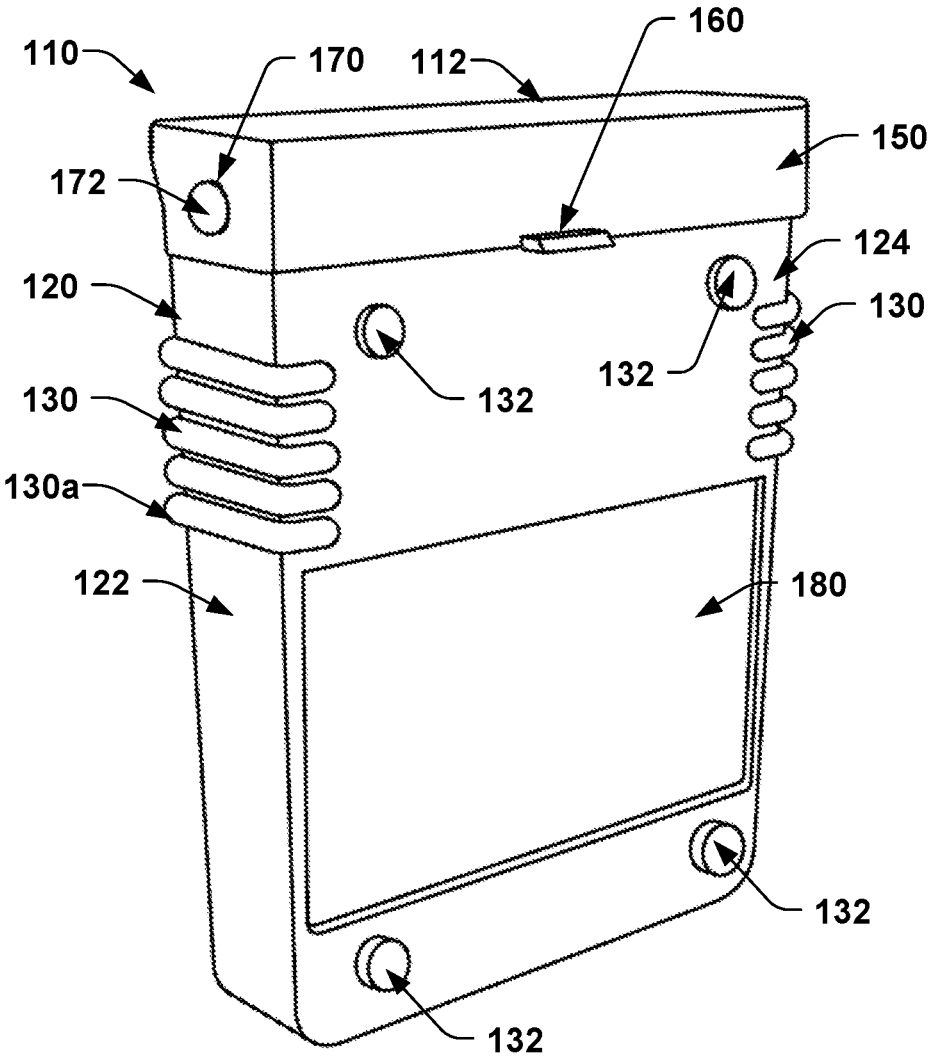
FIG. 1 depicts a perspective view of an exemplary container for dispensing food products or medication in an open position, in accordance with various embodiments.

Various embodiments of the present disclosure provide a container for dispensing food products or medication. The container may be flat and easy to store at retail locations, pharmacies, medicine cabinets, etc. Aspects of the present disclosure provides a container for dispensing food products or medication that is made of one-piece construction, thereby reducing manufacturing costs. Various embodiments provide increased efficiency for consumers, retailers, and/or pharmacists by including a lid and compartment for medicine and/or food products in the one-piece construction, thereby saving space and storage costs. Various embodiments provide a container for dispensing food products or medications that are connectable so that a user may easily store, travel, and/or carry the container(s). Various embodiments provide for an efficient manner of labeling and indexing containers for dispensing food products or medications.

Aspects of the present disclosure provide a container for dispensing food products or medication with a safety lock feature for preventing access to medications. Various embodiments of the present disclosure provide grips for ease of handling the container for dispensing food products or medications. Aspects of the present disclosure provide double protection of the contents of the container to ensure sanitary storage of the contents. Various embodiments of the present disclosure provide for dispensing different size medications or food products. The container for dispensing food products or medication may include a flat surface area for providing a label that is convenient and easy to read. Various embodiments of the present disclosure include an indexing label to aide in quickly and efficiently locating medications and relevant information.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

As used herein, an element or step recited in the singular and proceeded with the word “a” or “an” should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," "aspects of the present disclosure," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Moreover, although the terms "first," "second," etc. may be used herein to describe various elements, these elements should not be limited by these terms. These terms are only used to distinguish one element from another element. Thus, for example, a first element, a first component, a first side, or a first section discussed below could be termed a second element, a second component, or a second section without departing from the teachings of the present disclosure. Similarly, various spatial terms, such as "upper," "lower," "side," "top," "bottom" and the like, may be used in distinguishing one element from another element in a relative manner. It should be understood, however, that components may be oriented in different manners, for example a device may be turned sideways so that its "top" surface is facing horizontally and its "side" surface is facing vertically, without departing from the teachings of the present disclosure.

As used herein, medication or food products refer to tablets, capsules, caplets, pellets, pills, candies, treats, etc. In some examples, the medication or food products may be used to distribute dosages of medicine, vitamins, herbal supplements, other products, etc., as non-limiting examples. As used herein, a rectangular element or container is a quadrilateral with four right angles (including square-shaped elements and elements having a length that is different from a width).

Figure 2:
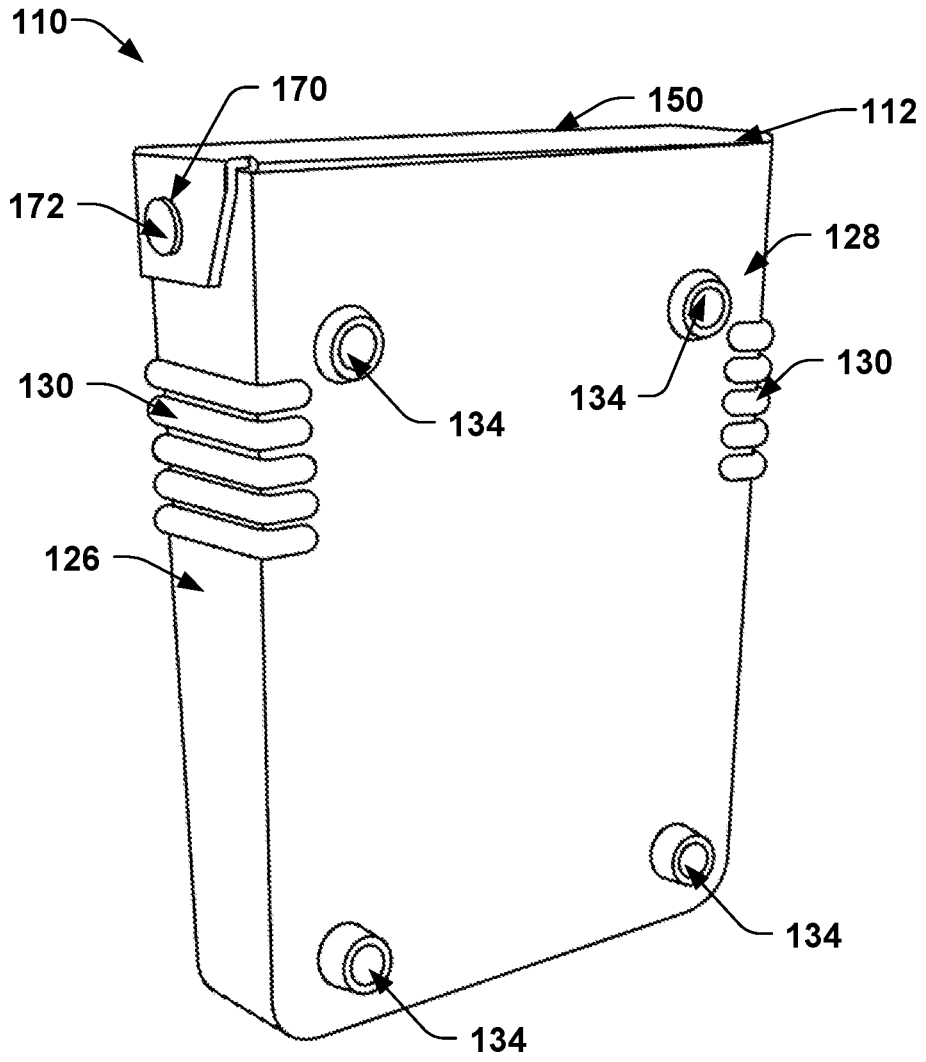
FIG. 2 depicts a first perspective view of an exemplary container for dispensing food products or medication in a closed position, in accordance with various embodiments.

FIG. 1 depicts a first perspective view of an exemplary container for dispensing food products or medication in a closed position, in accordance with various embodiments. FIG. 2 depicts a second perspective view of an exemplary container for dispensing food products or medication in a closed position, in accordance with various embodiments. Referring to FIGS. 1 and 2, the container 110 includes a rectangular compartment 120 and a lid portion 150. The rectangular compartment 120 and the lid portion 150 may be attached via a living hinge 112. The rectangular compartment 120 comprises a first side 122, a second side 124, a third side 126, and a fourth side 128. The first side 122 and third side 126 may be narrower than the second side 124 and the fourth side 128.

The rectangular compartment 120 further comprises gripping elements 130. Although FIG. 1 and FIG. 2 depicts the gripping elements 130 in a group of five on an exterior of the rectangular compartment 120, less gripping elements or more gripping elements may be provided. In some embodiments, a majority of each of the gripping elements 130 is located on a side of the rectangular compartment. For example, a majority of gripping element 130*a* may be placed horizontally on the first side 122 and extend partially to the second side 124 and the fourth side 128 (not shown). In some other embodiments, the gripping elements 130 may be placed horizontally entirely on a side of the rectangular compartment 120 and not wrap around to an adjacent side. The gripping elements 130 may be located on opposite sides of the rectangular compartment 120 (e.g., the first side 122 and the third side 126 or the second side 124 and the fourth side 128).

The rectangular component 120 further comprises connecting members which may be protruding connectors 132 and receiving connectors 134. The protruding connectors 132 may be located on an opposite side of the rectangular compartment 120 from the receiving connectors 134. For example, the protruding connectors 132 may be located on the second side 124 which is opposite the fourth side 128. The protruding connectors 132 and the receiving connectors of the container 110 may be used to connect the container 110 to other containers for dispensing food products or medications (not shown but described below, with regards to FIG. 7) by engaging the protruding connectors 132 and/or the receiving connectors 134 of the container 110 with connecting members of other containers for dispensing food products or medications.

Figure 3:
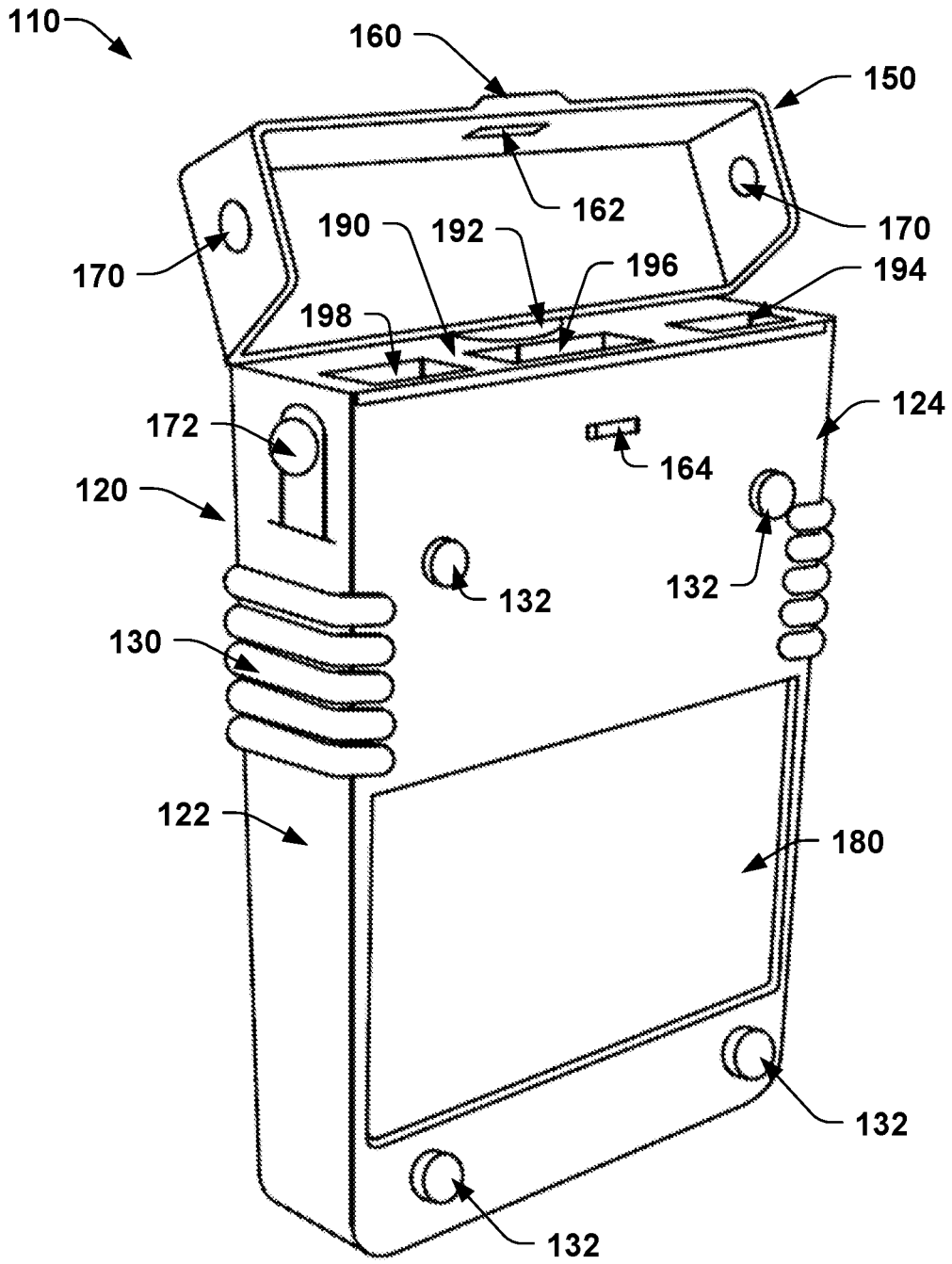
FIG. 3 depicts a second perspective view of an exemplary container for dispensing food products or medication in a closed position, in accordance with various embodiments.

A closing mechanism may be used to fasten the lid portion 150 to the rectangular compartment in a closed position. In some examples, the closing mechanism may include a snap fit tab 160 and a recess 162 on the lid portion 150, and a protrusion 164 on the rectangular compartment 120. In a closed position such as depicted in FIGS. 2 and 3, the protrusion 164 on the rectangular compartment 120 is engaged by the recess 162 on the lid portion 150. In order to open the lid portion 150, the snap fit tab 160 may be pushed and/or pulled upwards and/or away from the rectangular compartment 120, thus releasing the protrusion 164 from the recess 162 and allowing the lid portion 150 to open.

In some embodiments, a safety mechanism may be used to hinder opening of the container 110, for example, by a minor. The safety mechanism may include a safety aperture 170 on the lid portion 150 and a safety projection 172 on the rectangular compartment 150, as described with additional detail below, with regards to FIGS. 3 and 4. In a closed position, such as depicted in FIGS. 1 and 2, the safety projection 172 on the rectangular compartment 150 is received by the safety aperture 170 on the lid portion.

In some embodiments, the rectangular compartment 120 includes a label area 180 for adhesion of a label to provide information to consumers. The label area 180 provides a flat surface with sufficient space for a label. For example, a label may be provided with instructions, medical information, such as dosage information, name of patient, type of medication or food product included in the container, etc. Although the label area 180 is depicted on the second side 124, a label may alternatively or additionally be provided on first side 122, third side 126, and/or fourth side 128. The label area 180 allows a user to view, for example, dosage or food product information, quickly and efficiently.

The container 110 may be manufactured as one-piece construction. The container 110 may be manufactured of plastics suitable for food and/or medication. For example, the container 110 may be manufactured of polyethylene, polypropylene, polycarbonate, polystyrene, polypropylene, polyvinyl chloride, low-density polyethylene (LDPE plastic), or high-density polyethylene (HDPE) plastic. Additionally and/or alternatively, the container 110 may be stamped, molded, and/or cast.

Figure 4:
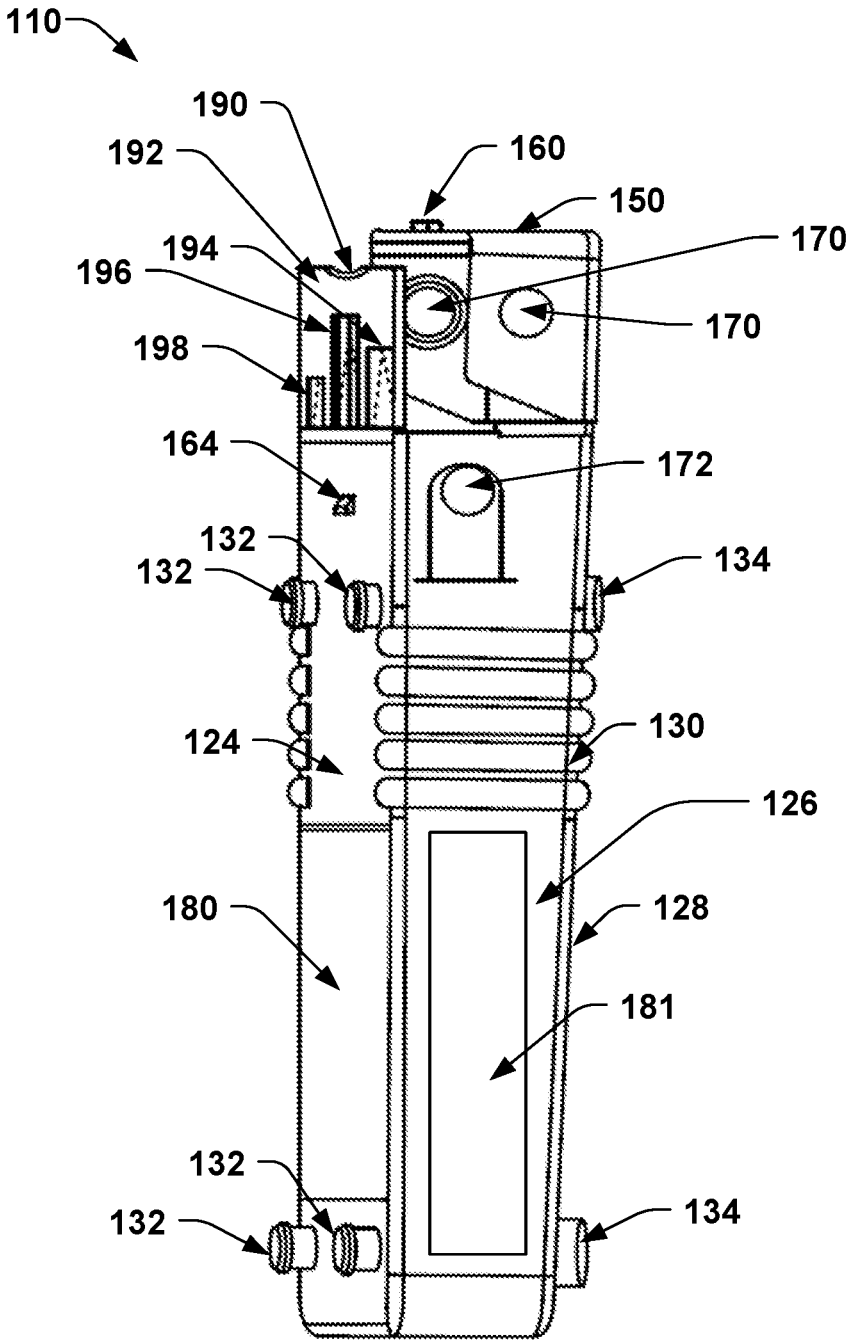
FIG. 4 depicts a side view of an exemplary container for dispensing food products or medication, in accordance with various embodiments.

FIG. 3 depicts a perspective view of an exemplary container 110 in an open position, in accordance with various embodiments. FIG. 4 depicts a side view of an exemplary container for dispensing food products or medication in an open position, in accordance with various embodiments. Referring to FIGS. 3 and 4, the container 110 comprises a rectangular compartment 120 and a lid portion 150. The rectangular compartment 120 comprises a first side 122, a second side 124, a third side 126, and a fourth side 128. The rectangular compartment 120 further comprises gripping elements 130 and connecting members which may be protruding connectors 132 and receiving connectors 134 as described above.

In some embodiments, a safety mechanism may be used to hinder opening of the container for dispensing food products or medication, for example, by a minor. The safety mechanism may include a safety aperture 170 on the lid portion 150 and a safety projection 172 on the rectangular compartment 150.

In order to open the container 110, a force may be placed on the safety projections 172 in order for the lid portion 150 to be disengaged from the rectangular compartment 120, thus allowing the lid portion 150 to be opened. In some examples, when both the closing mechanism and the safety mechanism are employed, a force may be placed on the safety projections 172, while simultaneously pushing and/or pulling the snap fit tab 160 to open the lid portion 150.

In some embodiments, the safety mechanism may be disabled by manipulating the safety projections 172 so that the safety projections are no longer received by the safety apertures 170 on the lid portion. The disabling may be performed, for example, by a doctor, pharmacist, nurse, medical practitioner, or other person who is responsible for dispensing medications to a patient.

In some embodiments, the rectangular compartment 120 comprises an appendage 190 that folds down securely to cover the top of the rectangular compartment 120. The appendage 190 may be attached to the rectangular compartment by a hinge 191, which may be a living hinge. The appendage 190 may help the contents free from contamination and includes an indentation 192 that may be used to pull the appendage 190 and open the container 110 to reveal the contents of the rectangular compartment 120. The appendage 190 may include a first perforation 194, a second perforation 196, and a third perforation 198. The first perforation 194, a second perforation 196, and a third perforation 198 may be different sizes, in order to dispense different size medication or food products. Although the second perforation 196 is depicted as the largest perforation, and the third perforation 198 is depicted as the smallest perforation, the different sizes may be placed in different positions on the appendage 190.

The appendage 190 may be manufactured with the first perforation 194, the second perforation 196, and the third perforation 198 and the area inside the perforation may be removed and/or pushed aside (e.g. inwards, or outwards to uncover the opening of each of the perforations) after manufacturing for the perforation that contains the appropriate dimensions for the contents of the container 110.

In some embodiments, the rectangular compartment 120 includes a label area 180 for adhesion of a label to provide information to consumers. The label area 180 provides a flat surface with sufficient space for a label. For example, a label may be provided with instructions, medical information, such as dosage information, name of patient, type of food and/or medication included in the container, etc. Additionally and/or alternatively an indexing label area 181 be provided. For example, the indexing label area 181 may be provided on a narrower side such as the first side 122, and/or the fourth side 128. The indexing label area 181 allows a user to quickly view information regarding the contents of the container 110.

Figure 5:
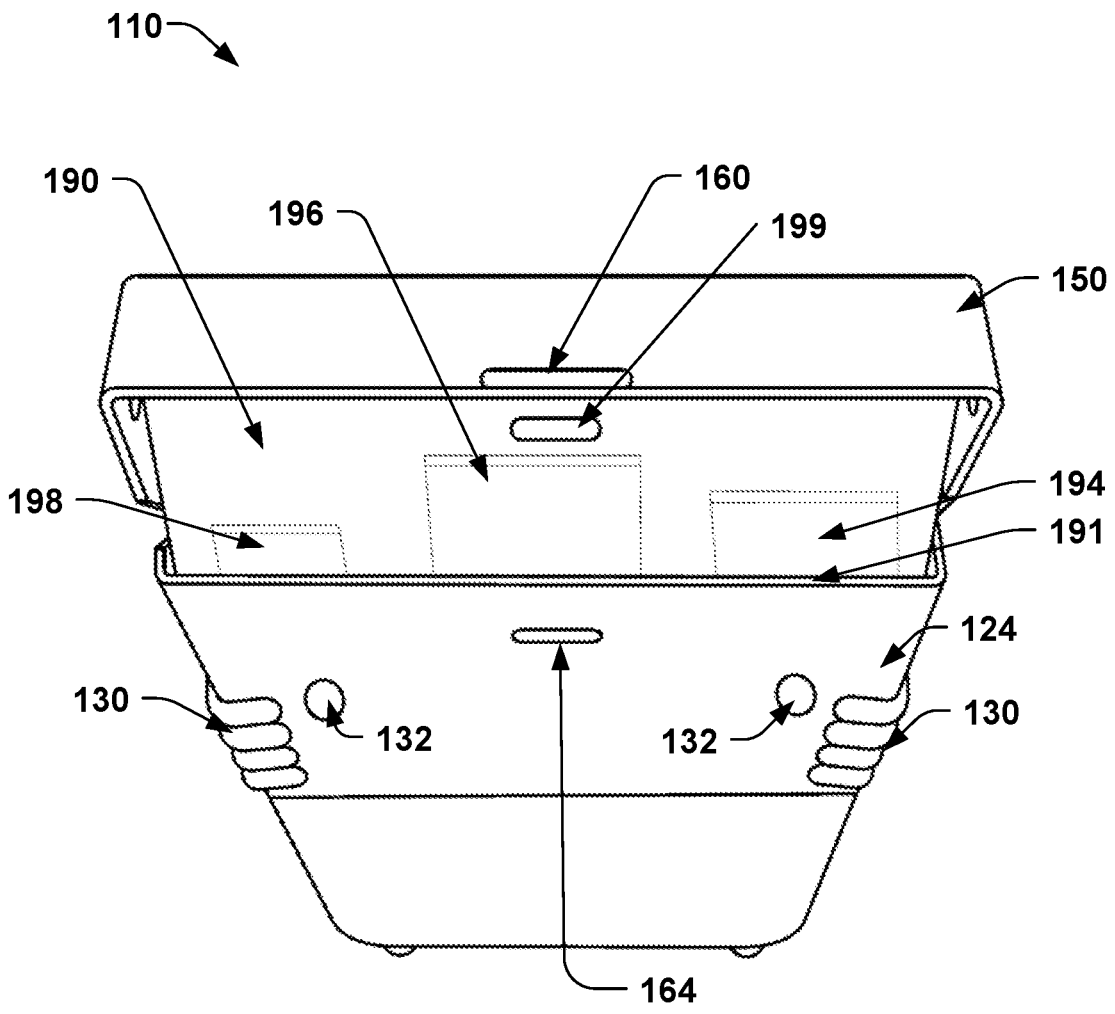
FIG. 5 depicts a top perspective view of an exemplary container for dispensing food products or medication, in accordance with various embodiments.

FIG. 5 depicts a top perspective view of an exemplary container 110 in an open position, in accordance with various embodiments. The container 110 comprises a rectangular compartment 120 and a lid portion 150. The rectangular compartment 120 includes gripping elements 130 which may be placed on one or more sides of the rectangular compartment 120 to allow a user to grip the rectangular compartment 120.

When the lid portion 150 is opened, as depicted, the appendage 190 is exposed. The appendage 190 may include one or more perforations, such as a first perforation 194, a second perforation 196, and a third perforation 198, which may be different dimensions in order to dispense different size medications and/or food products. The appendage 190 may also include a notch 199 (similar to the indentation 192 of FIG. 1, for example) to allow a user to open the appendage 190 in order to reveal the contents of the rectangular compartment 120. The rectangular compartment 120 may also include connecting members, which may be receiving members (not shown, but described above with regards to FIGS. 1-3) or protruding members 132 in order to allow containers to be connected together as described below with regards to FIG. 7.

Figure 6:
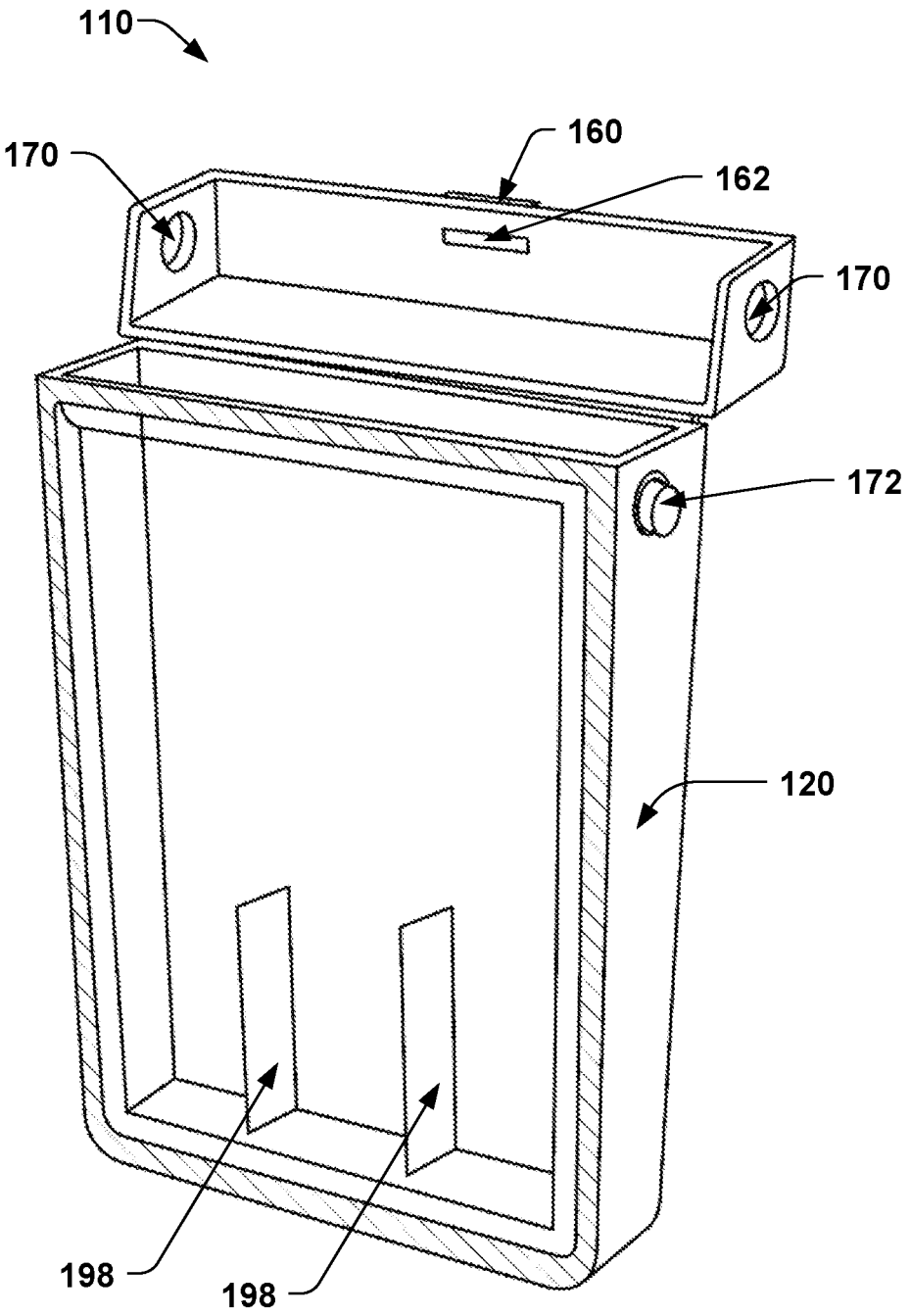
FIG. 6 depicts a cross-sectional view of an exemplary container for dispensing food products or medication, in accordance with various embodiments.

FIG. 6 depicts a cross-sectional view of an exemplary container for dispensing food products or medication, in accordance with various embodiments. The container 110 includes a rectangular compartment 120 and a lid portion 150. The rectangular compartment 120 and the lid portion 150 include a closing mechanism which includes the snap fit tab 160, recess 162, and protrusion (not shown) that are used to engage the rectangular compartment 120 and the lid portion 150. In some embodiments, the container 110 also includes a safety mechanism which includes a safety aperture 170 and a safety projection 172.

In some embodiments, the rectangular compartment 120 may also include one or more internal agitators 198. The internal agitators 198 may help separate medications and/or food products, and prevent them from adhering to each other. For example, gel tablets have a tendency to stick together, and the internal agitators 198 allow for easier dispensing by separating the gel tablets. Additionally and/or alternatively, a user may shake the container 110 in order to help separate the contents of the container 110 located within the compartment 120.

Figure 7:
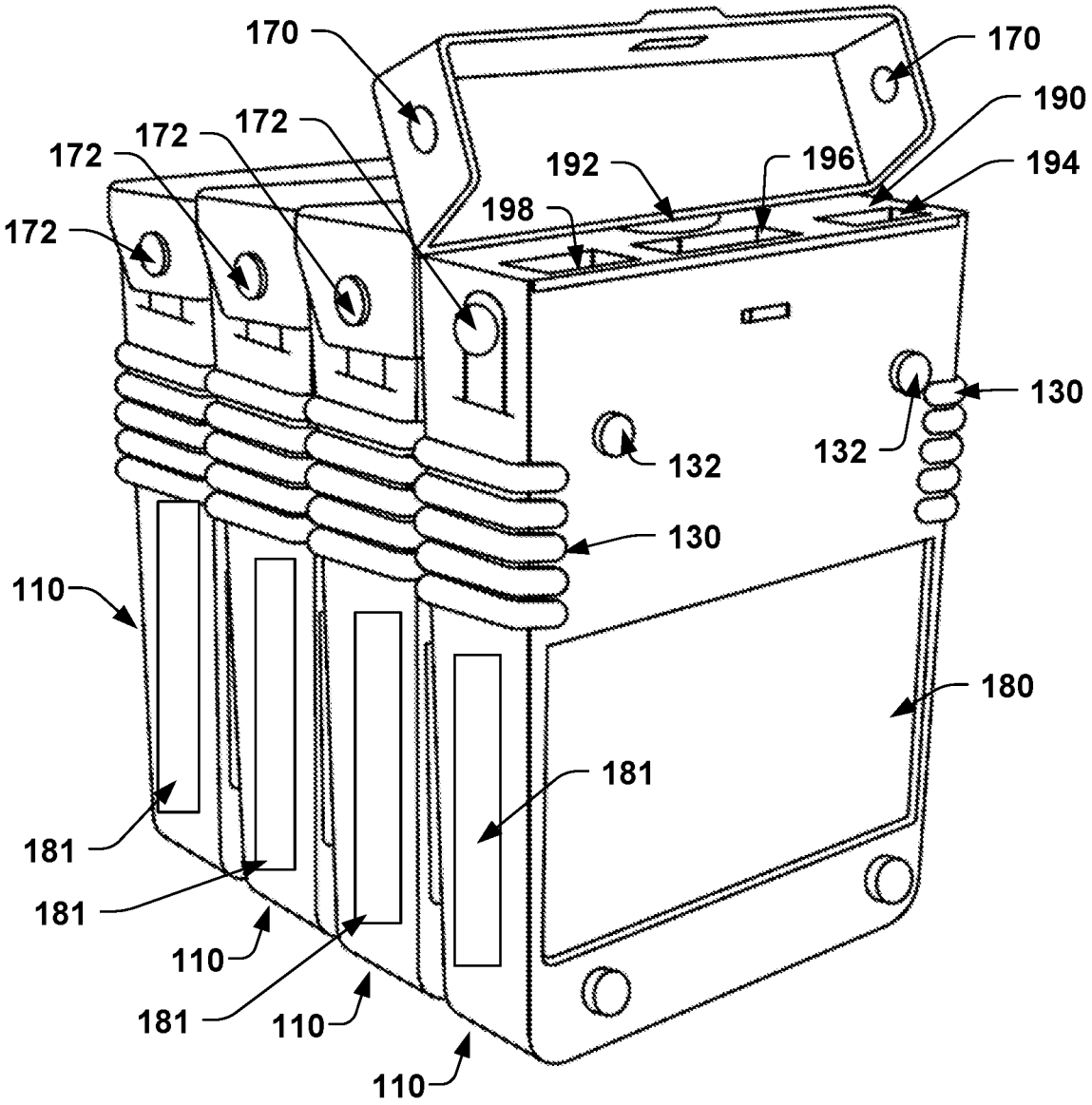
FIG. 7 depicts a perspective view of a plurality of connected container for dispensing food products or medications, in accordance with various embodiments.

FIG. 7 depicts a perspective view of a plurality of connected containers for dispensing food products or medications, in accordance with various embodiments. Each of the containers 110 includes connecting members such as protruding connectors 132 and receiving connectors 134 as described above. The protruding connectors 132 of one container may be received by receiving connectors (not shown, but depicted and described above with regards to FIG. 2) of another container, thereby allowing the containers 110 to be connected to each other, which aids in organizing storing, displaying, carrying, and/or finding medications.

In some embodiments, the rectangular compartment 120 includes a label area 180 for adhesion of a label to provide information to consumers as described above. Additionally and/or alternatively an indexing label area 181 be provided. For example, the indexing label area 181 may be provided on a narrower side such as the first side 122, and/or the fourth side 128. The indexing label area 181 allows a user to quickly view information regarding the contents of the container 110, such as when the containers 110 are connected together. For example, a user can quickly view index information on the indexing label area 181 when the containers 110 are connected as depicted in FIG. 7.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" or "configured" to perform a function whenever the component comprises the necessary structure to perform the function, regardless of whether the function is performed.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. A container for dispensing food products or medication comprising:

a rectangular compartment comprising:

a front side and a rear side opposite the front side, the front side and the rear side comprising a first width;

a first lateral side and a second lateral side opposite the first lateral side, the first lateral side and the second lateral side extending between the front side and the rear side, wherein the first lateral side and the second lateral side comprise a first height that is greater than a second width, and wherein the first width of the front side and the rear side is greater than second width of the first lateral side and the second lateral side;

a bottom side extending between the front side and the rear side, and extending between the first lateral side and the second lateral side, wherein the bottom side, the first lateral side, the second lateral side, the front side, and the rear side define a storage area accessible via a top opening;

gripping elements for gripping the rectangular compartment by a user, the gripping elements extending horizontally across an entirety of each of the first lateral side and the second lateral side, and connecting members comprising protruding connectors and receiving connectors, the front side having connecting members consisting of a first type of either the protruding connectors or the receiving connectors, the rear side having connectors consisting of a second type, opposite the first type of either the receiving connectors or the protruding connectors, the connecting members operable to attach one or more other containers to the container, wherein the first lateral side and the second lateral side are free of the connecting members; and a lid portion, wherein the rear side of the rectangular compartment and the lid portion are connected via a living hinge such that the lid portion is rotatable between a closed position covering the top opening and an open position providing access to the top opening, the lid portion comprising:

a closing mechanism operable to fasten the front side of the rectangular component to the lid portion; and a safety mechanism operable to hinder unfastening of the rectangular compartment and the lid portion, wherein the safety mechanism is operable separately and distinctly from the gripping elements.

2. The container for dispensing food products or medication of claim 1, wherein the safety mechanism comprises a safety aperture on the lid portion and a safety projection on the rectangular compartment, and wherein the safety projection is received by the safety aperture to secure the rectangular compartment and the lid portion.

3. The container for dispensing food products or medication of claim 2, wherein the safety projection is operable to be disengaged by directly receiving a force on the portion of the safety projection received in the safety aperture in order to disable the safety mechanism.

4. The container for dispensing food products or medication of claim 1, wherein the closing mechanism comprises a snap fit tab on the lid portion and a protrusion for engaging the snap fit tab on the rectangular compartment.

5. The container for dispensing food products or medication of claim 1, further comprising an appendage at a top edge of the rectangular compartment, the appendage comprising an indentation and configured to fold over the top edge to cover a substantial portion of the top opening.

6. The container for dispensing food products or medication of claim 5, wherein the appendage comprises one or more perforated portals for dispensing the food products or medication, each of the one or more perforated portals defined by perforations, the area within the perforations at least partially removeable to access the storage area with the rectangular compartment.

7. The container for dispensing food products or medication of claim 6, wherein the one or more perforated portals are two or more perforated portals, and wherein the area within the perforations of each of the two or more perforated portals are of different dimensions.

8. The container for dispensing food products or medication of claim 6, wherein the one or more perforated portals is a plurality of perforated portals, and wherein the area of one of the plurality of perforated panels is at least partially removed to dispense food products or medication through selected dimensions corresponding with the one of the plurality of perforated panels.

9. The container for dispensing food products or medication of claim 1, wherein the rectangular compartment further comprises internal agitators configured to provide an internal separation within the rectangular compartment.

10. The container for dispensing food products or medication of claim 1, wherein the protruding connectors are configured to fit into receiving connectors of a second container for dispensing food products or medication, and the receiving connectors are configured to receive protruding connectors of a third container for dispensing food products or medication.

11. The container for dispensing food products or medication of claim 1, wherein the front side, the first lateral side, and/or the second lateral side of the rectangular compartment comprises a label area to provide a surface for adhesion of a label to provide information to users.

12. The container for dispensing food products or medication of claim 1, wherein the gripping elements extend horizontally greater than the width of each of the first lateral side and the second lateral side.

13. The container for dispensing food products or medication of claim 1, wherein the gripping elements extend horizontally onto a portion of the front side and a portion of the rear side.

14. The container for dispensing food products or medication of claim 1, wherein the container is manufactured by one-piece construction.

15. The container for dispensing food products or medication of claim 14, wherein the container for dispensing food products or medication is manufactured of polyethylene, polypropylene, polycarbonate, polystyrene, polypropylene, polyvinyl chloride, Low-density polyethylene (LDPE plastic), or HDPE (high-density polyethylene) plastic.

16. The container for dispensing food products or medication of claim 14, wherein the container is stamped, molded, or cast.

* * * * *